US006783615B1

(12) United States Patent
Van Biert et al.

(10) Patent No.: US 6,783,615 B1
(45) Date of Patent: Aug. 31, 2004

(54) INSENSITIVE EXPLOSIVES FOR HIGH SPEED LOADING APPLICATIONS

(75) Inventors: Keith Van Biert, Kenvil, NJ (US); Donald A. Geiss, Jr., Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 8 days.

(21) Appl. No.: 10/248,568

(22) Filed: Jan. 29, 2003

Related U.S. Application Data

(60) Provisional application No. 60/352,195, filed on Jan. 29, 2002.

(51) Int. Cl.[7] ..... C06B 45/10
(52) U.S. Cl. ..... 149/19.3; 149/19.7
(58) Field of Search ..... 149/19.3, 19.7

(56) References Cited

U.S. PATENT DOCUMENTS 4,011,818 A * 3/1977 Stosz et al. ..... 149/19.9
4,976,794 A * 12/1990 Biddle et al. ..... 149/19.5
H1111 H * 11/1992 Dunn et al. ..... 264/3.1
5,210,153 A * 5/1993 Manser et al. ..... 149/19.6
5,540,794 A * 7/1996 Willer et al. ..... 149/19.1
5,547,526 A * 8/1996 Wanninger et al. ..... 149/19.2
5,565,150 A * 10/1996 Dillehay et al. ..... 264/3.3
5,567,912 A * 10/1996 Manning et al. ..... 149/12
5,627,339 A * 5/1997 Brown et al. ..... 149/19.3

* cited by examiner

*Primary Examiner*—Edward A. Miller
(74) *Attorney, Agent, or Firm*—Robert Charles Beam; John F. Moran

(57) ABSTRACT

An insensitive high energy explosive is disclosed which can be processed on high speed loading equipment without significant buildup of explosive material on the tooling of the high speed loading equipment. The insensitive high energy explosive comprises (a) from about eighty to about ninety-six percent (80.0 to 96.0%) by weight of a high energy explosive chosen from the group comprising cyclotetramethylene tetranitramine (HMX), cyclotrimethylylene trinitramine (RDX), or hexanitrohexaazaisowurtzitane (CL-20); (b) from about two and four-tenths to about twelve percent (2.4 to 12.0%) by weight of an energetic plasticizer, preferably a 1:1 mixture of BIS 2,2-Dintropropylacetate and BIS 2,2-Dinitropropyl formal (BDNPA/F); (c) from about one and six-tenths to about eight percent (1.6 to 8.0%) by weight CAB binder system; and, (d) about one half of one percent (0.5%) fluorocarbon additive, preferable a Teflon-type additive commercially available under the Trade name Zonyl® MP 1100.

6 Claims, No Drawings

INSENSITIVE EXPLOSIVES FOR HIGH SPEED LOADING APPLICATIONS

CROSS REFERENCE TO RELATED APPLICATIONS

This Application claims priority of U.S. Provisional Application Serial No. 60/352,195, Filed Jan. 29, 2002.

FEDERAL RESEARCH STATEMENT

The invention described herein may be made, used, or licensed by or for the United States Government for Government purposes without the payment of any royalties thereon or therefore.

BACKGROUND OF INVENTION

1. Field of the Invention

The present invention relates to high energy explosive materials. In particular, the present Invention relates to high energy insensitive explosive materials which can be machined on high speed loading equipment more easily.

2. Description of Related Art

High energy explosive materials have been known for many years, and formulations have been successfully loading in high speed mechanical loading equipment. In recent years, however, there has been a long-term effort to make such high energy explosives more insensitive and therefore safer to manufacture and handle.

This has led to some difficulties in production processes, such as high speed loading, particularly when an insensitive explosive did not have the same flow characteristics as the high energy explosive previously employed. Loading of high speed sub-munitions is a good example. The equipment upon which such loading has been done was designed to handle Composition A5, which contains 98.5% crystalline RDX with only 1.5% binder. When such machinery attempts to load an insensitive munitions explosive such as PAX 2A IM, which contains an increased amount of plasticizer/binder, the increased binder increases the friction and the resultant buildup of explosive material residue on the tooling/equipment.

SUMMARY OF INVENTION

Object of the Invention

It is an object of the present to provide an insensitive high energy explosive which will accommodate use in high speed loading equipment without dangerous residue.

It is another object of the present Invention to provide an insensitive high energy explosive which will accommodate use in high speed loading equipment without dangerous residue, and without compromising explosive performance.

The other objects, features and advantages of the present invention will become more apparent in light of the following detailed description of the preferred embodiment thereof.

SUMMARY OF THE INVENTION

According to one embodiment of the present invention, there is provided an insensitive high energy explosive which can be processed on high speed loading equipment without significant buildup of explosive material on tooling of said high speed loading equipment, said insensitive high energy explosive comprising: a. from about eighty to about ninety-six percent (80.0 to 96.0%) by weight of a high energy explosive chosen from the group comprising cyclotetramethylene tetranitramine (HMX), cyclotrimethylylene trinitramine (RDX), or hexanitrohexaazaisowurtzitane (CL-20); b. from about two and four-tenths to about twelve percent (2.4 to 1 2.0%) by weight of an energetic plasticizer; c. from about one and six-tenths to about eight percent (1.6 to 8.09) by weight cellulose acetate butyrate (CAB) binder system; and, d. about one half of one percent (0.5%) fluorocarbon additive.

According to another embodiment of the present invention, there is provided an insensitive high energy explosive which can be processed on high speed loading equipment without significant buildup of explosive material on tooling of said high speed loading equipment, said insensitive high energy explosive comprising:

a. from about eighty-five to about ninety percent (85.0 to 90.0%) by weight of a high energy explosive chosen from the group comprising cyclotetramethylene tetranitramine (HMX), cyclotrimethylylene trinitramine (RDX), or hexanitrohexaazaisowurtzitane (CL-20);

b. from about four to about 8ight percent (4.0 to 8.0%) by weight of an energetic plasticizer;

c. from about two to about six percent (2.0 to 6.0%) by weight CAB binder system; and, d. about one half of one percent (0.5%) fluorocarbon additive.

According to another embodiment of the present invention, there is provided a n insensitive high energy explosive which can be processed on high speed loading equipment without significant buildup of explosive material on tooling of said high speed loading equipment, said insensitive high energy explosive comprising:

a. about eighty-five percent (85.0%) by weight of a high energy explosive chosen from the group comprising cyclotetramethylene tetranitramine (HMX), cyclotrimethylylene trinitramine (RDX), or hexanitrohexaazaisowurtzitane (CL-20);

b. about nine percent (9.0%) by weight of an energetic plasticizer;

c. about six percent (6.0%) by weight CAB binder system; and, d. about one half of one percent (0.5%) fluorocarbon additive

DETAILED DESCRIPTION

The insensitive explosive composition designated PAX 2A was developed in the late 1980's as a less sensitive high explosive replacement for use in main charge warhead applications of conventional munitions. This explosive nominally contains 85% cyclotetramethylene tetranitramine (HMX), 9% of a 1:1 ratio mixture of BIS 2,2-Dinitropropylacetate and BIS 2,2-Dinitropropyl formal (BDNPA/F) and 6% Cellulose Acetate Butyrate (CAB). This composition has been demonstrated the Research and Development testing to provide a significant increase in survivability against unplanned stimuli over conventional high explosives.

While this composition has exhibited superior insensitivity, its use has been limited, particularly in high speed loading applications where residues of explosive material can quickly build up on process tooling and result in dangerous conditions or necessitate numerous shut downs for cleaning of the tooling. Many iterative loading trials have been conducted with PAX-2A in submunitions on a non-production basis for testing and evaluation. Prior to the present invention, only about 500 grenade submunitions could be run successfully before the rotary presses would become contaminated with explosive. Operations were suspended due to safety concerns. Typical production levels for this equipment are approximately 125 parts per minute, with a yield of about 30,000 parts per 10 hour shift, when loading conventional Composition A5 explosive, with only a tertiary cleaning of the press equipment being conducted 4 times per shift to vacuum up residual powder on the press face.

The present invention will permit the use of PAX explosives to run full 10-hour shifts (30,000) parts without equipment contamination or tooling sticking problems that would otherwise result in lower product output and unacceptable manufacturing costs. The present invention directly solves the problem of high speed rotary press loading grenade submunitions for sustained high rate production with insensitive explosives. The scientific principles presented in this invention will also be applicable to all other methods of press loading with newer insensitive formulations formulations containing eighty percent (80%) to ninety-six percent (96%) solids level cyclotetramethylene tetranitramine (HMX), cyclotrimethylene trinitramine (RDX) or hexanitrohexaazaisowurtzitane (CL-20); with two and four-tenths percent (2.4%) to twelve percent (12.0%) on a :I1 mixture of BIS 2,2-dinitropropylacetate and BIS 2.2-dinitroproyl formyl (BDNPA/F) energetic plasticizer and one and six-tenths percent (1.6%) to eight percent (8.0%) cellulose acetate butyrate (CAB) binder systems.

The present invention employs the use of up to one half of one percent (0.5%) measured on an "as added" basis, of a Teflon-type fluorocarbon additive. In the illustrated embodiment, Zonyl® MP 1100, a Teflon-type fluorocarbon additive commercially available from the E.I duPont deNemours Corp. was employed effectively. The addition of this additive to an insensitive high explosive formulation will prevent the sticking or buildup of explosive on press tooling part surfaces. At the same time, in the testing done to date, the addition of this additive does not reduce the strength of the high explosive formulation.

Table 1 below summarizes test runs carried out with PAX 2A in producing grenade submunitions on the high speed presses.

TABLE 1

| Test Date | Press Type | Additive (by weight percent) | Total No. Of Units | Significant Contamination |
|---|---|---|---|---|
| 3/95 | High Speed Production | Cab-O-Sil 0.4% | 10 | Yes |
| 3/97 | High Speed Production | None | 547 | Yes |
| 6/97 | High Speed Production | None | <200 | Yes |
| 4/99 | Hand Load on Rotary Press | None | 5 | No |
| 9/99 | High Speed Production | None | <100 | Yes |
| 9/99 | High Speed Production | Graphite 0.5% | <100 | Yes |
| 9/99 | High Speed Production | None | 177 | Yes |
| 9/99 | High Speed Production | Graphite 0.065% | 380 | Yes |
| 9/99 | High Speed Production | None | 463 | Yes |
| 4/00 | Single Stage Press | Mold Release on Tooling | ~15 | Yes |
| 8/00 | High Speed Production | None | 527 | Yes |

TABLE 1-continued

| Test Date | Press Type | Additive (by weight percent) | Total No. Of Units | Significant Contamination |
|---|---|---|---|---|
| 8/00 | High Speed Production | None | <100 | Yes |
| 7/01 | High Speed Production | None | 993 | Yes |
| 10/01 | High Speed Production | None | 60 | Yes |
| 10/01 | High Speed Production | None | 262 | Yes |
| 11/01 | Production Tooling | None | 47 | Yes |
| 11/01 | Production Tooling | None | 91 | Yes |
| 11/01 | Production Tooling | None | 47 | Yes |
| 11/01 | Production Tooling | None | 21 | Yes |
| 11/01 | Production Tooling | Zonyl ® MP 1100 0.5% | 91 | No |
| 11/01 | Production Tooling | Zonyl ® MP 1100 0.5% | 91 | No |
| 11/01 | Production Tooling | Calcium Stearate 0.5% | 91 | Yes |
| 11/01 | Production Tooling | Cab-O-Sil 0.5% | 91 | Yes |
| 11/01 | Production Tooling | Aerosil R972 (silica) 0.5% | 91 | Yes |
| 11/01 | Production Tooling | Synthetic Silica 0.5% | 10 | Yes |
| 11/01 | High Speed Production | Zonyl ® MP 1100 0.5% | ~1000 | No |
| 11/01 | High Speed Production | Zonyl ® MP 1100 0.5% | ~500 | No |

High speed loading of munitions, such as the grenade submunition in which the present invention has been employed, have a number of tolerance-critical parts in the loading process. The grenade submunition loading equipment, for example, has a swage ring groove for a copper liner to be swaged. High speed loading involves the use of a powder guide to guide the explosive into the fill section of the grenade without contamination of the swage area. This has long been a problem area in attempting to load insensitive explosive compositions.

This difficulty exists in part because the machinery was designed for the loading of a substantially crystalline conventional explosive, Composition A5, which contains ninety-eight and one-half percent (98.5%) crystalline solids of cyclotrimethylene trinitramine (RDX) with only one and one-half percent (1.5%) binder. The higher binder levels of insensitive high explosive materials create a contamination of the press die faces and gears that is a safety hazard and which is not acceptable for high rate production loading. The build-up of powder is caused by increased frictional forces which are created as the material travels through the hopper and shoe of the powder feed system. This permits the explosive to build-up and overflow onto the press die face and gears.

These increased frictional forces are inherent by design with less sensitive explosives since they contain lower solids levels and a higher percentage of binders in their compositional matrix. The PAX-2A IM explosive, for example, contains considerably less of the crystalline solids (85%), while having an increased amount of plasticizer/binder materials (15%). It is believed to be the increased binder material that contributes to the increased friction and the resultant buildup of explosive residue on the tooling and equipment.

The present invention allows for a cost effective means for the high speed loading of munitions such as the grenade submunitions detailed herein, without equipment or tooling modifications. Previous attempts to find solutions to this problem, such as coating of tooling and equipment parts with Teflon-type frictionless coatings, have not proven effective, since existing equipment cannot be coated without loss of critical tolerances and newly dimensioned tooling, to accommodate such coatings, would wear too quickly to be useful.

Notwithstanding the addition of the additive employed herein, however, tests demonstrate that the explosive power of the insensitive high explosive compositions are not compromised, as they are with the addition of other additives. Table 2 shows the results of this testing.

TABLE 2

| Date Loaded | Additive | Quantity Tested | Penetration (Inches) |
|---|---|---|---|
| 8/00 | None | 28 | 3.09 |
| 3/95 | Cab-O-Sil | 10 | 2.88 |
| 9/99 | Graphite | 30 | 3.00 |
| 11/01 | Zonyl ® MP 1100 | 90 | 3.10 |

It has also been determined that the preferred embodiment of the present invention has a reduced coefficient of friction when compared to the same explosive formulation without the Teflon-type additive. In testing, the coefficient of friction of PAX 2A was measured at greater than 200 g/cm-sec$^2$, while the preferred embodiment was measured to be less than 180 g/cm-sec$^2$. It is believed that the lower coefficient of friction increases the ability of the material to flow through the high speed loading equipment hoppers and feed shoes in a more efficient manner. This allows the use of a broader particle size distribution and increases cost effectiveness. It could also allow for a cleaner running press, since materials with a high coefficient of friction were proven to have a detrimental effect on high speed loading equipment in actual plant trials.

In contrast to the limited production methodologies shown for many specialty products in the literature; the preferred embodiment of the present invention can be manufactured by a variety of processes, since the ingredient that affords the beneficial effect is blended into the end product. Methods of manufacture are: 1) vertical mix and granulate in a one step process; 2) slurry mix; 3) horizontal sigma blade mix and granulate in two steps; 4) batch process vertical mix, slurry mix or horizontal sigma blade mix, then extrude and cut or granulate; and, 5) continuous TSE and cut or granulate. In theory, each of these methodologies could be employed as long as the end product maintains particle sizes and bulk densities that are compatible for the specific loading application and the material produced has a coefficient of friction of less than about 180 g/cm-sec$^2$. The material employed in the testing reported herein was prepared by the first method.

In practice, the particle size distribution is driven by the inherent flexibility of the particular high speed loading equipment design that is used to load the desired munitions. The particle size distribution therefore could be tailored to give the customer the most cost effective process (highest manufacturing yield compatible to loading application) that will maintain the system performance requirement. For example, for grenade submunition loading for which the present invention has been successfully demonstrated, a minimum bulk density of about 0.85 g/cc with a particle size distribution through a 6 mesh and retained on a 30 mesh was found to provide the most cost effective yield of vertical mix material that still meets all insensitive munitions and performance requirements for the M91 5DPICM system. For high-speed production of larger items such as tank rounds, it could be more cost effective to load a broader particle size distribution with a similar bulk density. For high speed loading of small low density booster pellets or pre-pellets for in-cartridge bullet or in-body munition fabrication, it could be more cost effective to load a tighter particle size distribution with a lower bulk density requirement.

The different mixing methodologies which may be employed are the following:1) vertical mix and granulate in a one step process: CAB polymer is pre-dissolved in ethyl acetate by heating at 140° F. for 24 hours prior to a mix. At the start of a mix, this solution, along with the BDNPA/F, is added to the mix bowl which had been preheated to 165° F. The preheating kept the mix at 120 to 130° F. Following the addition of polymer solution, the HMX is added to the mix and mixed on low speed for 10 minutes until well coated. Next, vacuum and/or an argon sweep is applied to remove solvent until it appeared that a maximum bulk density and yield had been obtained. The material is further dried to remove any remaining solvent.

2) slurry mix: A slurry mixer containing baffles, temperature controls and an air driven agitator can be used as follows. The mixer is initially charged with 25 to 40% capacity with water, heated to 30 to 65° C. and agitated at 300 to 450 rpm. To the water is added the desired percentage solids (HMX, RDX, or CL-20) to form a slurry, which is agitated until the temperature is stabilized. Next, the desired percentage of BDNPA/F (50/50%) is added to the slurry. Then, the desired percentage of CAB, dissolved in solvent, is added slowly over a 5 to 10 minute period (the BDNPA/F can be incorporated into the CAB/solvent lacquer instead of being added separately). Evacuate still, maintain temperature and increase agitation rate to 375 to 500 rpm. After mixing for five minutes, additional water or solvent is added as particles form and grow. Judgment must be used to vary additional mix time, water or solvent addition and agitator speed to achieve the desired particle size. Typically, the slurry is again mixed for 5 to 15 minutes with water or solvent added, and an increase in agitation rate to 450 to 750 rpm. After the desired particle size and shape is achieved, the heat source is removed, and water is added to quench, followed by mixing for a few more minutes. Agitation is then ceased, and granules are collected from the mixer, rinsed, then dried on a screen at 21 to 57° C. for 12 to 48 hours.

3) horizontal sigma blade mix and granulate in two steps: Mix 4 parts ethyl acetate and 1 part ethyl alcohol. The total solvents used would equal approximately 20 to 30 percent of the total mix weight. Add to this mix the target ratio of HMX, CAB, and BDNPA/F. These ingredients are mixed for approximately 1 to 2 hours, at a temperature of 105 to 120° F. The system is blowndown with $CO_2$, and then cooled down to room temperature and granulated through the desired sieve size mesh screen. This material is then dried at ambient temperature for 1 day, and then oven dried to remove remaining solvents until total volatiles are 0.02% or less.

4) batch process vertical mix, slurry mix or horizontal sigma blade mix, then extrude and cut or granulate: The vertical mix, slurry mix or horizontal blade mix procedure would follow the description above, however, the material would be removed at a well mixed homogeneous reduced solvent stage. The solvent level would be adjusted to provide the mixture with an acceptable viscosity for extruding. The material would then be fed through a twin screw extruder (TSE) or a ram extruder. The extrudate strands are then cut into grains or run through an automated granulator. This material would then be dried at ambient temperature for a day, and then oven dried to remove remaining solvents until total volatiles are 0.02% or less. This is not, however, believed to be a cost effective means for the manufacture of the present invention.

5) continuous TSE and cut or granulate: For continuous twin screw extrusion, the feeding order of the ingredients is very important. Improper feeding order can lead to conditions which result in formation of a gel that sticks to mixer surfaces leading to deterioration of mixing quality. There should be at least two zones of mixing. In the first zone, the CAB should be mixed with the BDNPA/F. This zone should consist of conveying right-handed fully flighted elements followed by 60-degree forward and 60-degree reverse kneading discs. Ideally, the CAB should be fed first, followed by the BDNPA/F. A temperature of about 35° C. at the barrel is adequate. In the second mixing zone, solids (HMX, RDX, etc.) and solvent should be added through ports directly above the conveying fully flighted right-handed elements, which are to be kept partially-full during processing. This allows for premixing of solids and solvents. The conveying elements should again be followed by 60° forward and 60° reverse kneading disc elements. Thus, overall there will be two mixing zones, both sealed with 60° reverse staggering kneading discs. This procedure works well provided that the correct degree of fill is maintained in the extruder. The ingredient feed rates, screw rpm's and time of mixing per zone need to be varied per TSE size and configuration until a homogeneous product is extruded. The extruded product is then cut into grains or run through a granulator. This could be a very cost effective means for PAX 2A explosive manufacture.

During the 1990's many munitions systems considered the use of insensitive explosive compositions for main charge warhead applications but the use of such compositions was generally unsatisfactory. Since the turn of the twenty-first century, however, many of those systems must be redesigned to meet insensitive munitions compliance, including booster pellets which require higher HMX solids levels. The current RDX-based PAX IM formulations are not as effective on a performance basis with HMX formulations, but are much cheaper to produce because of the lower cost of RDX. Therefore, it is envisioned that higher solids levels, such as 91 to 93% RDX would be a useful lower cost replacement for 85 to 87% HMX filled PAX explosives. Performance calculations data show near equivalence in performance with the higher percentage of RDX, and the present invention will enable such compositions to be employed in existing munitions loaded on existing equipment.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An insensitive high energy explosive which can be processed on high speed loading equipment without significant buildup of explosive material on tooling of said high speed loading equipment, said insensitive high energy explosive comprising:

a. from about eighty to about ninety-six percent (80.0 to 96.0%) by weight of a high energy explosive chosen from the group comprising cyclotetramethylene tetranitramine (HMX), cyclotrimethylylene trinitramine (RDX), or hexanitrohexaazaisowurtzitane (CL20);

b. from about two and four-tenths to about twelve percent (2.4 to 12.0%) by weight of an energetic plasticizer, c. from about one and six-tenths to about eight percent (1.6 to 8.0%) by weight cellulose acetate butyrate (CAB) binder system; and, d. about one half of one percent (0.5%) fluorocarbon additive.

2. The insensitive high energy explosive of claim 1 in which the energetic plasticizer is a 1:1 mixture of BIS 2,2-Dintropropylacetate and BIS 2,2-Dinitropropyl formal (BDNPA/F).

3. An insensitive high energy explosive which can be processed on high speed loading equipment without significant buildup of explosive material on tooling of said high speed loading equipment, said insensitive high energy explosive comprising:

a from about eighty-five to about ninety percent (85.0 to 90.0%) by weight of a high energy explosive chosen from the group comprising cyclotetramethylene tetranitramine (HMX), cyclotrimethylylene trinitramine (RDX), or hexanitrohexaazaisowurtzitane (CL-20);

b. from about four to about 8ight percent (4.0 to 8.0%) by weight of an energetic plasticizer;

c. from about two to about six percent (2.0 to 6.0%) by weight CAB binder system; and, d. about one half of one percent (0.5%) fluorocarbon additive.

4. The insensitive high energy explosive of claim 3 in which the energetic plasticizer is a 1:1 mixture of BIS 2,2-Dintropropylacetate and BIS 2,2-Dinitropropyl formal BDNPA/F.

5. An insensitive high energy explosive which can be processed on high speed loading equipment without significant buildup of explosive material on tooling of said high speed loading equipment, said insensitive high energy explosive comprising:

e. about eighty-five percent (85.0%) by weight of a high energy explosive chosen from the group comprising cyclotetramethylene tetranitramine (HMX), cyclotrimethylylene trinitramine (RDX), or hexanitrohexaazaisowurtzitane (CL-20);

f. about nine percent (9.0%) by weight of an energetic plasticizer, g. about six percent (6.0%) by weight CAR binder system; and, h. about one half of one percent (0.5%) fluorocarbon additive.

6. The insensitive high energy explosive of claim 5 in which the energetic plasticizer is a 1:1 mixture of BIS 2,2-Dintropropylacetate and BIS 2,2-Dinitropropyl formal (BDNPA/F).

* * * * *